United States Patent [19]

Sakaki

[11] 4,136,729

[45] Jan. 30, 1979

[54] HEAT ACCUMULATING MEMBER FOR A ROTARY HEAT-ACCUMULATION TYPE HEAT EXCHANGER OF A GAS TURBINE ENGINE

[75] Inventor: Yoshihiro Sakaki, Tokyo, Japan

[73] Assignee: Nissan Motor Company, Limited, Japan

[21] Appl. No.: 870,110

[22] Filed: Jan. 17, 1978

Related U.S. Application Data

[63] Continuation-in-part of Ser. No. 673,479, Apr. 5, 1976, abandoned.

[51] Int. Cl.[2] ..... F28D 19/04

[52] U.S. Cl. ..... 165/9; 165/10

[58] Field of Search ..... 165/8, 9, 10; 60/39.51 H

[56] References Cited

U.S. PATENT DOCUMENTS

| | | | |
|---|---|---|---|
| 3,276,515 | 10/1966 | Whitfield | 165/10 |
| 3,534,807 | 10/1970 | Bracken, Jr. | 165/10 X |
| 3,797,087 | 3/1974 | Allardyce et al. | 165/10 X |
| 3,901,309 | 8/1975 | Thebert | 165/10 X |

*Primary Examiner*—Albert W. Davis, Jr.
*Attorney, Agent, or Firm*—Lowe, King, Price & Becker

[57] ABSTRACT

A heat accumulating member for a rotary heat-accumulation type heat exchanger of a gas turbine engine, in which a flat sheet and a corrugated sheet are wound around a hub rotatably mounted in the heat exchanger. The flat sheet has a thickness of about 2.5 times that of the corrugated sheet whereby deformation of the heat accumulating member due to gas pressure and high temperature of gases is prevented.

3 Claims, 9 Drawing Figures

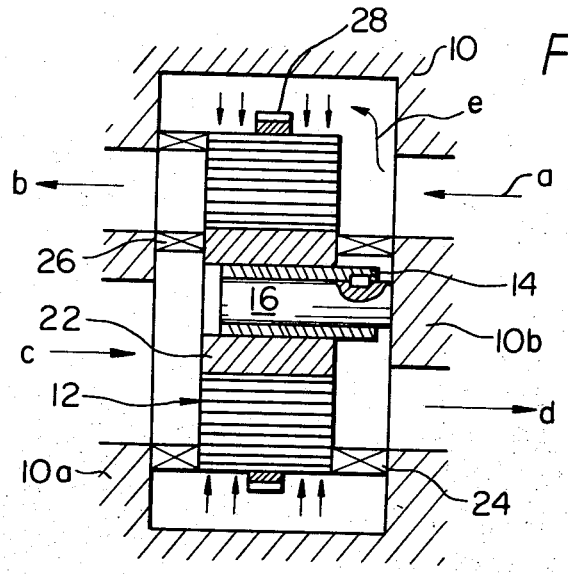
Fig. 1
Fig. 3
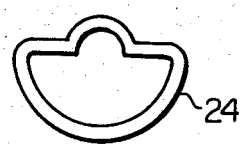
Fig. 2
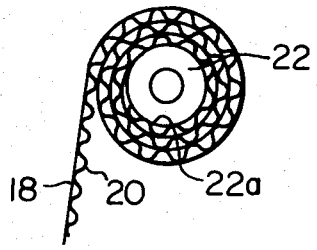
Fig. 4
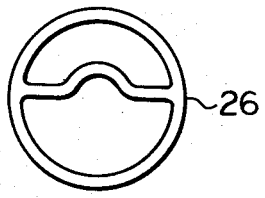

HEAT ACCUMULATING MEMBER FOR A ROTARY HEAT-ACCUMULATION TYPE HEAT EXCHANGER OF A GAS TURBINE ENGINE

This application is a continuation-in-part of Ser. No. 673,479, filed Apr. 5, 1976 now abandoned.

This invention relates to a rotary heat-accumulator type heat exchanger and, more particularly, to a heat accumulating member for such heat exchanger.

As is well known, it has been a common practice to have a gas turbine engine equipped with a rotary heat-accumulator type heat exchanger which is arranged to preheat compressed air by exhaust gases emitted from a turbine for improving thermal efficiency thereby to save fuel consumption. A conventional heat exchanger of this type usually comprises a heat accumulating member comprised of a corrugated sheet and a sheet of metal carrying the corrugated sheet, which member is wound on a rounded piece. Since this heat accumulator member is subjected to high temperature during operation of the gas turbine engine, it deforms to greater extent and, in this case, the gas turbine engine will cease to operate.

It is therefore an object of the present invention to provide an improved heat accumulating member for a rotary heat-accumulator type heat exchanger of a gas turbine.

It is another object of the present invention to provide an improved heat accumulating member for a rotary heat-accumulator type heat exchanger of a gas turbine which is simple in construction and has a long life.

It is still another object of the present invention to provide an improved heat accumulating member for a rotary heat-accumulator type heat exchanger of a gas turbine which provides ease of assembly and low manufacturing costs.

These and other objects, features and advantages of the present invention will become more apparent from the following description when taken in conjunction with the accompanying drawings, in which:

FIG. 1 is a cross sectional view of a conventional heat-accumulator type heat exchanger of a gas turbine;

FIG. 2 is a cross sectional view of a heat accumulating member forming part of a device shown in FIG. 1;

FIG. 3 is a plan view of a sealing member forming part of the device shown in FIG. 1;

FIG. 4 is similar to FIG. 3 but shows another sealing member;

Figure 5:
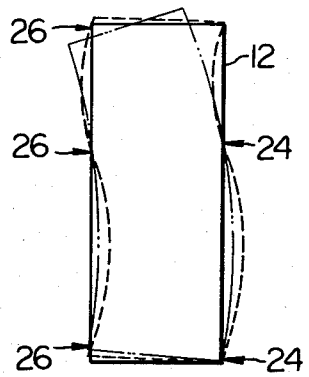
FIG. 5 is a schematic view illustrating a mode of deformation of the heat accumulating member shown in FIG. 2.

Referring now to FIG. 1, there is shown an example of a conventional heat exchanger of a gas turbine engine. As customary, the heat exchanger comprises a casing 10 including a high temperature side fixed wall 10*a* and a low temperature side fixed wall 10*b* between which a heat accumulating member 12 is rotatably mounted on a bearing 14 fixed to a shaft 16 which is connected to the low temperature side fixed wall 10*b*. As best shown in FIG. 2, the heat accumulating member 12 is comprised of a plane sheet of metal 18 and a corrugated sheet 20 which are wound around a hub 22 rotatably mounted on the bearing 14. Indicated at 22*a* is a notch to which a leading end of the heat accumulating member is fixed. A sealing ring 24 is disposed between one face of the heat accumulating member 12 and the low temperature side fixed wall 10*b*, and a sealing member 26 is disposed between another face of the heat accumulating member 12 and the high temperature side fixed wall 10*a*.

As shown in FIG. 1, the heat accumulating member 12 is provided on its periphery with an outer ring gear 28 meshing with a pinion (not shown) which is driven by a suitable drive source so that the heat accumulating member 12 is rotated. During rotation of the heat accumulating member 12, compressed air from a compressor passes through the heat exchanger in directions shown by arrows a and b, which exhaust gases pass in directions as shown by arrows c and d. The exhaust gases heat the heat accumulating member 12 which in turn heats the compressed air passing therethrough, and the heat exchanging effect is thus performed. FIG. 3 shows an example of the sealing member 24, and FIG. 4 shows an example of a sealing member 26.

Figure 6:
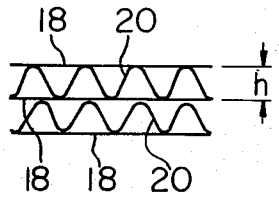
FIG. 6 is a fragmentary cross sectional view of the heat accumulating member before it is deformed.
Figure 7:
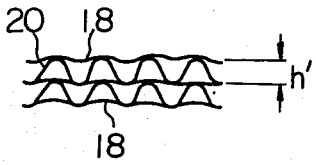
FIG. 7 is similar to FIG. 6 but shows the heat accumulating member after it has been deformed.
Figure 8:
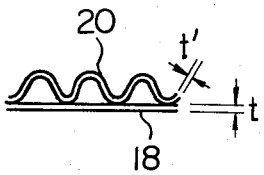
FIG. 8 is a cross section of a preferred embodiment of a heat accumulating member according to the present invention.

It is to be noted that the compressed air flowing in the direction of arrow a will flow in the direction of arrow e in FIG. 1 toward an area around an outer periphery of the heat accumulating member 12 to apply pressure P thereon to provide a pressure balance. In this case, even when the shaft 16 is supported at its end, it is not subjected to a larger bending moment. However, the shaft 16 tends to deform in a manner as shown by dotted line in FIG. 5 because of pressure loss between the compressed air and the low pressure exhaust gases and because of softening effect of the material due to high temperature. In actual case, however, the pressure loss of the exhaust gases is greater than that of the compressed air and, therefore, the heat accumulating member 12 is softened at a portion near the sealing member 26 provided on the high temperature side. In this instance, the flat sheet 18 is caused to deform to a greater extent so that the size h of FIG. 6 will decrease in a manner as shown by the size h' in FIG. 7 with a result that the heat accumulating member 12 will be deformed in a manner as shown by phantom line in FIG. 5. Since, at this instant, the sealing member is movably disposed, the slight degree of deformation of the heat accumulating member 12 is absorbed by the displacement of the sealing member and, thus, the sealing effect is maintained. However, if the heat accumulating member 12 is deformed to an excessive extent, a gap is formed between the sealing member 26 and the heat accumulating member 12 increasing gas leakages whereby the gas turbine engine will be stopped in operation.

To solve this problem, if the heat accumulating member 12 is reinforced in construction by increasing the thicknesses of the flat sheet 18 and the corrugated sheet 20, operating efficiency of the heat accumulating member 12 is decreased resulting in the increase in the pressure loss so that the performance efficiency of the heat accumulating member 12 is sacrificed.

Figure 9:
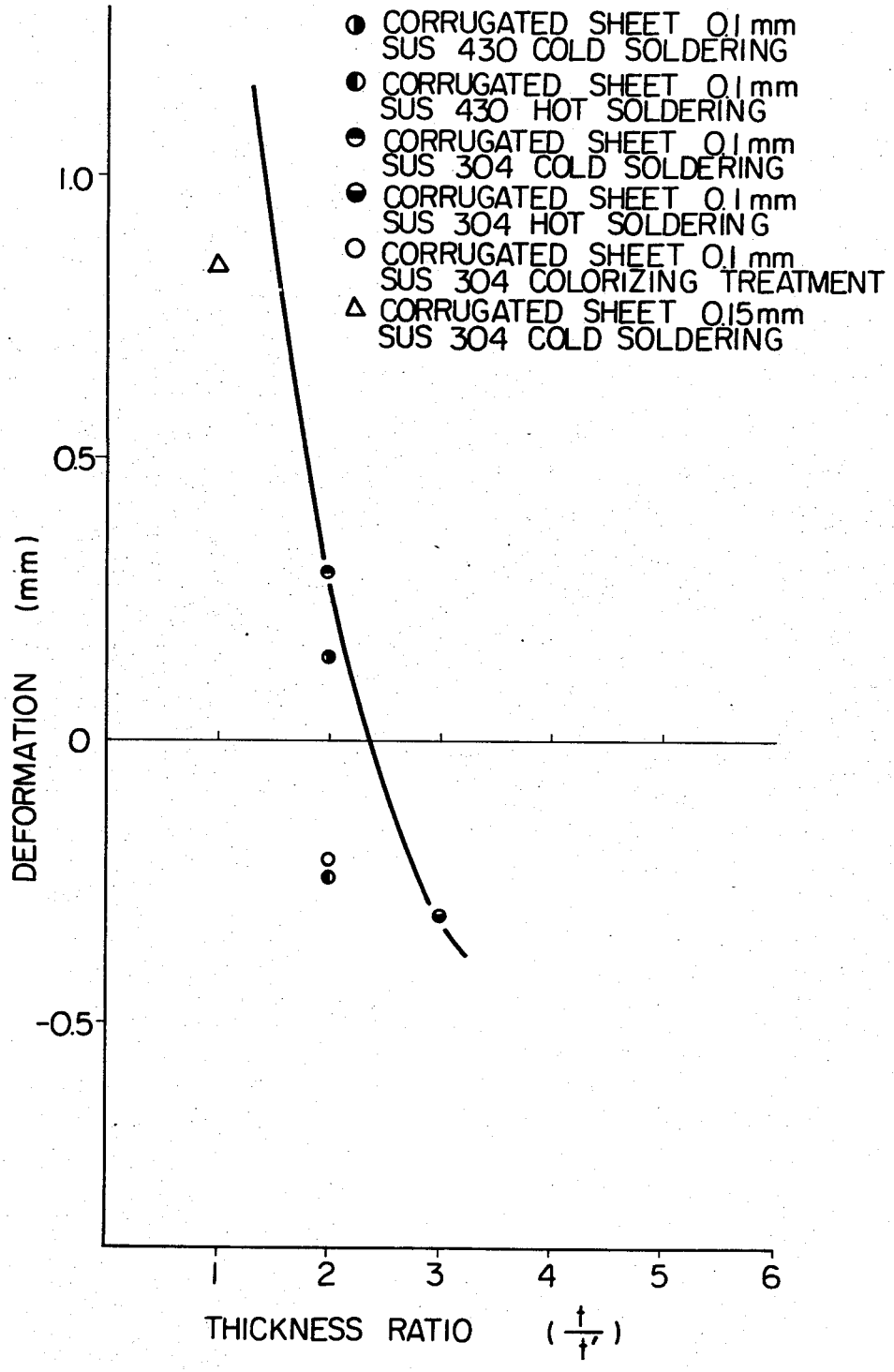
FIG. 9 is a graph showing deformation versus thickness rates of the heat accumulating member of FIG. 8.

The present invention contemplates to overcome the shortcomings encountered in the prior art without causing any difficulties and is based on the fact that the deformation of the heat accumulating member is caused by the deformation of the flat sheet. In accordance with an essential feature of the present invention, the flat sheet 18 has a thickness t of about 2.5 times the thickness t' of the corrugated sheet 20. In evaluating the thickness of the flat sheet 18, it is preferred that the thickness of the flat sheet 18 is determined to have a value corresponding to a minimum value in strength required for the flat sheet 18. Excessive larger thickness of the flat sheet 18 will be useless and decreases the operating efficiency of the heat accumulating member 12. Regardless of the absolute thickness t of sheet 18, deformation of the member 12 is eliminated at the thickness ratio t/t' of about 2.5, as shown in FIG. 9.

Since, thus, the present invention overcomes the shortcomings encountered in the prior art by increasing the thickness of the flat sheet, the operating efficiency of the heat accumulating member is not deteriorated while reliably preventing the deformation of the flat sheet at the high temperature side. Thus, a gap can not be formed between the heat accumulating member and the sealing member.

It is to be noted that it is unnecessary to increase the thickness of the flat sheet over its entire area and the same result will be obtained by increasing a portion of the flat sheet near the high temperature side.

While the present invention has been shown and described with reference to a particular embodiment, it should be noted that various changes or modifications may be made without departing from the scope of the present invention.

What is claimed is:

1. In a heat accumulating member for rotary heat-accumulation type heat exchanger of a gas turbine engine, the improvement comprising a hub rotatably mounted on a shaft of the heat exchanger; a flat sheet of metal; and a corrugated sheet of metal attached to said flat sheet into an integral unit which is wound around said hub; at least a portion of said flat sheet near the high temperature side having a thickness of about 2.5 times that of said corrugated sheet for eliminating deformation of said heat accumulating member due to softening effect of a material of said flat sheet because of gas pressure and high temperature of gasses without sacrificing engine operating efficiency.

2. The improvement according to claim 1, in which said heat exchanger includes a casing having a high temperature side fixed wall and a low temperature side fixed wall, a first sealing ring disposed between one side face of said heat accumulating member and said high temperature side fixed wall, and a second sealing ring disposed between another side face of said heat accumulating member and said low temperature side fixed wall.

3. In a heat accumulating member for a rotary heat-accumulation type heat exchanger of a gas turbine engine and including a casing in which the heat accumulating member is exposed to high temperature and pressure gases, the improvement comprising a flat sheet of metal and a corrugated sheet of metal which are wound around a hub rotatably mounted on a shaft on the heat exchanger, at least a portion of said flat sheet exposed to the high temperature and pressure gases having a thickness of about 2.5 times that of the corrugated sheet for eliminating deformation of said heat accumulating member due to softening effect of said flat sheet because of gas pressure and high temperature of gases without sacrificing engine operating efficiency.

* * * * *

UNITED STATES PATENT OFFICE

CERTIFICATE OF CORRECTION

Patent No. 4,136,729 Dated January 30, 1979

Inventor(s) Yoshihiro Sakaki

It is certified that error appears in the above-identified patent and that said Letters Patent are hereby corrected as shown below:

Page 1, after Filed: Jan. 17, 1978, should read:

Foreign Application Priority Data

April 14, 1975 [JP] Japan ..... 50-36611

Signed and Sealed this

*Thirty-first* Day of *July 1979*

[SEAL]

*Attest:*

*Attesting Officer*

LUTRELLE F. PARKER

*Acting Commissioner of Patents and Trademarks*